US006555018B2

(12) United States Patent
Sellers et al.

(10) Patent No.: US 6,555,018 B2
(45) Date of Patent: Apr. 29, 2003

(54) BONDED MAGNETS MADE WITH ATOMIZED PERMANENT MAGNETIC POWDERS

(75) Inventors: Charles Howard Sellers, Idaho Falls, ID (US); Barry Hal Rabin, Idaho Falls, ID (US); Wilhelm Ervens, Essen (DE); Joseph James Worden, Apex, NC (US); Viswanathan Panchanathan, Anderson, IN (US)

(73) Assignee: Magnequench, Inc., Indianapolis, IN (US)

( * ) Notice: Subject to any disclaimer, the term of this patent is extended or adjusted under 35 U.S.C. 154(b) by 0 days.

(21) Appl. No.: 09/794,018

(22) Filed: Feb. 28, 2001

(65) Prior Publication Data

US 2002/0157733 A1 Oct. 31, 2002

(51) Int. Cl.[7] ..... H01F 1/26
(52) U.S. Cl. ..... 252/62.54; 148/302
(58) Field of Search ..... 148/302; 252/62.54

(56) References Cited

U.S. PATENT DOCUMENTS

| | | | | | |
|---|---|---|---|---|---|
| 4,902,361 | A | | 2/1990 | Lee et al. | 148/302 |
| 5,149,477 | A | | 9/1992 | Yamashita et al. | 264/112 |
| 5,186,766 | A | | 2/1993 | Iriyama et al. | 148/301 |
| 5,242,508 | A | | 9/1993 | McCallum et al. | 148/101 |
| 5,279,785 | A | | 1/1994 | Mohri et al. | 419/2 |
| 5,376,291 | A | | 12/1994 | Watanabe | 252/62.54 |
| 5,393,445 | A | | 2/1995 | Furuya et al. | 252/62.54 |
| 5,474,623 | A | | 12/1995 | Ma et al. | 148/101 |
| 5,486,240 | A | | 1/1996 | McCallum et al. | 148/102 |
| 5,587,024 | A | | 12/1996 | Nakayama et al. | 148/101 |
| 5,647,886 | A | | 7/1997 | Kitazawa et al. | 75/235 |
| 5,716,462 | A | * | 2/1998 | Sakurada et al. | 148/302 |
| 5,750,044 | A | | 5/1998 | Yoneyama et al. | 252/62.54 |
| 5,905,424 | A | | 5/1999 | Panchanathan | 335/302 |
| 6,007,757 | A | | 12/1999 | Honkura et al. | 264/429 |
| 6,019,859 | A | * | 2/2000 | Kanekiyo et al. | 148/302 |
| 6,022,424 | A | | 2/2000 | Sellers et al. | 148/101 |

OTHER PUBLICATIONS

The Japan Institute of Metals, 2000, by V. Panchanathan, Current Status in Bonded Nd–Fe–B Magnets, pp. 431–447, Dec. 2000.

Gorham/Intertech Consulting, "Polymer Bonded Magnets 98", Cincinnati, OH., 1998.

* cited by examiner

*Primary Examiner*—John Sheehan
(74) *Attorney, Agent, or Firm*—Pennie & Edmonds LLP

(57) ABSTRACT

The invention relates to magnets, particularly bonded magnets, of the Re—Fe—B type made from atomized magnetic powders and to methods of producing the powders and the magnet. The magnetic powders comprise, by weight, about 15% to 25% of RE; about 0.8% to 2.0% of B; about 1% to 10% of T; and balanced with Fe, Co, or mixtures thereof; wherein RE is one or more rare earth elements selected from the group consisting of Y, La, Ce, Pr, Nd, Sm, Er, Gd, Tb, Dy, Ho, Tm, Yb and Lu, and T is one or more elements selected from the group consisting of Ti, Zr, Hf, V, Nb, Ta, Cr, Mo, and W. To produce bonded magnets, the atomized powders are heat treated, combined with a binder, pressed or molded, and cured to produce the bonded magnets. As compared to bonded magnets made from melt-spun powders or from other conventional atomized powders, bonded magnets of the present invention exhibit one or more of the following properties: less loss of intrinsic coercivity under repeated injection molding cycles; less internal magnetic shearing loss; improved flowability of the magnetic powders; improved Br and part integrity; less environmental degradation after exposure to high temperature and less flux loss; complex shapes and high part integrity; lower viscosity of the magnetic powder-binder mixtures; and high magnetic strength even for small-dimension magnets.

26 Claims, No Drawings

BONDED MAGNETS MADE WITH ATOMIZED PERMANENT MAGNETIC POWDERS

FIELD OF THE INVENTION

The present invention relates to magnets and methods for producing magnets. More specifically, the invention relates to magnets, particularly bonded magnets, made from atomized permanent magnetic powders, and methods for producing such powders and magnets.

BACKGROUND OF THE INVENTION

Bonded magnets are made from magnetic powders bonded together by binder, usually an organic or metallic resin. Although bonded magnets usually have lower magnetic energy compared to their fully-densified counterparts, such as sintered magnets, bonded magnets have wide industrial applicability because of their excellent formability—the ability of forming magnets in complex forms with high mechanical tolerance. In fact, the bonded magnet market has experienced the fastest growth of any permanent magnet market. Examples of bonded magnet applications include appliances, consumer electronics, automotives, factory automation, medical devices, computers, and office automation.

Bonded magnets are usually made from magnetic powders of Ferrite, Nd—Fe—B, Sm—Co, or Sm—TM (a combination of Co, Fe, Cu, Zr, and Hf), although recently other types of bonded magnets are also reported, such as the Sm—Fe—N type magnet disclosed in U.S. Pat. Nos. 5,750,044 and 5,186,766. One major growth area of bonded magnet is that of the Nd—Fe—B type. Many modifications have been made since the first bonded Nd—Fe—B magnet was disclosed in U.S. Pat. No. 4,902,361. For example, the use of special binders has been reported in U.S. Pat. Nos. 5,393,445; 5,149,477 and 5,376,291. A hybrid type of bonded magnet is reported in U.S. Pat. No. 5,647,886. The use of coating to improve corrosion resistance in bonded magnet is disclosed in U.S. Pat. No. 5,279,785. Anisotropic bonded magnets have been reported in U.S. Pat. Nos. 5,587,024 and 6,007,757.

Traditionally, the highest strength bonded magnets are made from rapidly solidified Nd—Fe—B powders produced by melt-spinning. In fact, melt-spinning still forms the basis for almost the entire bonded Nd—Fe—B magnet industry. In a melt-spinning process, a molten alloy mixture is flowed onto the surface of rapidly spinning wheel. Upon contacting the wheel surface, the molten alloy mixture forms ribbons, which solidify into flake or platelet particles. The flakes obtained through melt-spinning are relatively brittle and have a very fine crystalline microstructure. The flakes can also be further crushed or comminuted before being used to produce magnets. The cooling rate can be controlled by both the mass flow rate and the wheel spinning speed.

Although the melt-spinning process is the only commercially available process to achieve the necessary cooling rates to form good quality magnetic powders from $Nd_2Fe_{14}B$ type alloy melts, it suffers from a number of drawbacks such as: microstructural non-homogeneity due to non-uniform quenching; a large number of voids existing between the powder particles that lead to low density and powder oxidation; and difficulties in magnet forming operations due to the large particle size and irregular shapes of the flakes.

Another potential method of producing rapidly solidified powders for making bonded magnets is atomization, although it has never been used widely on a commercial scale. Atomization is the breakup of a liquid into small droplets. Different types of atomization processes, such as gas atomization, water atomization, vacuum atomization, and centrifugal atomization, have been used for years to produce certain alloy powders. Although atomization has the potential of producing magnetic powders at a much higher mass flow rate than the melt-spinning process, it has not been commercially used to produce powders for making bonded magnets. One major drawback of atomization processes is that the cooling rate is generally lower than that of the melt-spinning processes, which usually results in inadequate quenching and poor magnetic properties of the magnetic powders. Attempts have been made in recent years to improve the applicability of atomization process in producing powders for making magnets. Atomized Nd—Fe—B powders have been used to make bonded magnets as given in U.S. Pat. No. 5,905,424. In U.S. Pat. No. 5,242,508, a spherical powder is given a protective coating to make a fully dense magnet. In U.S. Pat. No. 5,474,623, the method of making magnetically anisotropic spherical powder is reported. U.S. Pat. No. 6,022,424 discloses a method of using atomization to produce magnetic powders comprising a $R_{2.1}Q_{13.9}B_1$ structure.

The powders and bonded magnets disclosed in these references, however, all suffer from one or more of the following drawbacks: loss of intrinsic coercivity; corrosion instability in the magnet making process; internal magnetic shearing loss due to the characteristics of the magnetic powders; low volumetric loading due to the shape and other characteristics of the magnetic powders; difficulties in the loading and packing processes due to low flowability of the powders; high flux and remanence loss due to exposure to high temperatures; difficulties in processing due to high viscosity; and difficulties in producing small-dimension magnets with high magnetic strength and high part integrity due to the characteristics of the powders and methods used for producing bonded magnets from the powders.

When making a bonded magnet, magnetic powders, whether produced by melt-spinning or by atomization, are usually interspersed with a binder, which can be a polymer such as any thermoset or thermoplastic, or a metal such as zinc. Bonded magnets can then be formed from the powder-binder mixture by various processes—compression molding (compaction), injection molding, extrusion, calendering, thin layer, thin foil and thick sheets by using screen printing, spin casting, or slurry coating. Injection molding is usually used to produce bonded magnets of complex shapes with integrated components. However, injection molding requires good flowability of the magnetic powder-binder mixture, which usually is achieved by limiting the volume fraction of the magnetic powders, resulting in lower magnetic energy for the magnets. Compression molding usually produces magnets with relatively high energy because it can produce magnets from powder-binder mixtures with high volume fraction of magnetic powder due to its tolerance to lower flowability. However, compression molding suffers from its inability to produce very small magnets or magnets with complex shapes. Extrusion molding is a good process for continuous production of magnets, with a low cost of production. Even though extrusion molding does not have the strict requirement for flowability as does injection molding, the complexity of the magnets produced is limited due to the nature of the process.

In addition to the above mentioned drawbacks in the present production of bonded magnets using different processes, there are other general problems associated with the production of magnetic powders and bonded magnets such as material waste due to low process yield, cracking and/or distortion of the magnets due to limits on the loading of materials, and rejection due to dimensional variations. These problems all increase the cost and affect the magnetic properties of the final products.

SUMMARY OF THE INVENTION

The present invention provides magnets, particularly bonded magnets, that overcome or alleviate some or all of the drawbacks associated with the currently available bonded magnets. The invention also provides methods for producing the bonded magnets. Specifically, the present invention overcomes the above mentioned drawbacks by using magnetic powder made by atomization and composition control. More specifically, the present invention provides a bonded magnet made from magnetic powders that are obtained by an atomization process and comprise, by weight, about 15% to 25% of RE; about 0.8% to 2.0% of B; about 1% to 10% of T; and balanced with Fe, Co, or mixtures thereof, wherein RE is one or more rare earth elements selected from the group consisting of Y, La, Ce, Pr, Nd, Sm, Er, Gd, Tb, Dy, Ho, Tm, Yb and Lu, and T is one or more elements selected from the group consisting of Ti, Zr, Hf, V, Nb, Ta, Cr, Mo, and W.

Preferably, the magnet of the present invention is made of magnetic powders having the general formula $Nd_2Fe_{14}B$, comprising a metallurgical structure substantially having $Nd_2Fe_{14}B$ as the primary magnetic phase. The magnetic powders of the present invention may further comprise one or more of additional elements such as Cu, Si, Al, Sn, and Ga present in quantities up to 1%, and may also further comprise other elements such as C, N, O, P, and S, present as impurities.

In a more preferred embodiment, the present invention provides bonded magnets made from magnetic powders that comprise, by weight, about 18% to 20% of Nd, about 1.8% to 2.2% of Ti, about 3.8% to 4.2% of Zr, about 1.4% to 1.8% of B, and balanced with Fe. In another more preferred embodiment, the magnetic powders comprise, by weight, about 23% to 24% of Nd, about 3.8% to 4.2% of Co, about 1.1% to 1.3% of B, about 1.4% to 1.6% of Ti, about 2.2% to 2.4% of Zr, about 0.1% to 0.3% of Cu, and balanced with Fe. In yet another more preferred embodiment of the present invention, the magnetic powders comprise, by weight, about 22% to 23% of Nd, about 8% to 10% of Co, about 1.1% to 1.3% of B, about 1.7% to 1.8% of Nb, about 3.1% to 3.3% of Zr, about 0.1% to 0.3% of Cu, about 0.1% to 0.3% of C, and balanced with Fe.

In another preferred embodiment of the present invention, the magnets are made from magnetic powders that are substantially spherical and have diameters ranging from about 1 $\mu$m to about 200 $\mu$m. In another preferred embodiment of the present invention, the magnets are made from magnetic powders that comprise a mixture of particles that are substantially spherical and have diameters ranging from about 1 $\mu$m to about 200 $\mu$m with flake particles that are between about 50 $\mu$m and about 500 $\mu$m in length and between about 20 $\mu$m and about 100 $\mu$m in thickness. The magnets of the present invention are preferably isotropic and are produced by an atomization process selected from one or more of gas atomization, centrifugal atomization, water atomization, vacuum atomization, plasma spraying, and sputtering.

The bonded magnet of the present invention may further comprise a binder selected from the group consisting of thermosetting resins, thermoplastic resins, metals, and mixtures thereof. Preferably, the binder is polyamide, PPS, nature or synthetic rubber, or epoxy.

In a preferred embodiment, the bonded magnet of the present invention is obtained through compression molding, extrusion molding, injection molding, calendering, screen printing, spin casting, slurry coating, or combinations thereof. More preferably, the magnet is obtained through injection molding, wherein the loss of intrinsic coercivity of the magnet after four injection molding cycles is less than about 5%.

The bonded magnet of the present invention is preferably made from a mixture of the magnetic powders and the binder. In a more preferred embodiment, the magnetic powders comprise from about 40% to about 99%, by volume, of the magnetic powder-binder mixture and the internal loss of the bonded magnet is less than about 4%. In another more preferred embodiment, the magnetic powders comprise from about 63% to about 69% or greater, by volume, of the magnetic powder-binder mixture and wherein the magnet has no cracking and/or physical distortion and can be manufactured using conventional molding equipment.

In another preferred embodiment, the bonded magnet of the present invention is made from a magnetic powder-binder mixture that has an apparent viscosity of less than about 500 poise at a shear rate of more than about 20 $\text{second}^{-1}$ and a temperature of about 240° C.

The bonded magnet of the present invention is further preferably made from magnetic powders having good flowability. More preferably, the magnetic powders are capable of flow through a standard Hall flowmeter orifice at a rate of more than about 2 grams per second, and preferably more than about 3.5 grams per second.

In another preferred embodiment of the present invention, the bonded magnet has a loss of remanence of less than about 30% when exposed to a temperature of about 260° C. for about 200 hours. Furthermore, the bonded magnet of the present invention preferably has a flux loss of less than about 3% when aged at a temperature of about 100° C. for about 2000 hours.

The present invention further provides bonded magnets with small dimensions and high magnetic strength. For example, the total volume of the magnet may be less than about 50 $mm^3$ and the greatest dimension of the magnet is less than about 5 mm. Bonded magnets of such dimensions possess a magnetic flux density of more than may be achieved using conventional flake powders. In a preferred embodiment, the Br value for such magnets is greater than about 4.0 kGauss and, more preferably, greater than about 4.8 kGauss.

In another aspect, the present invention provides a method of making a bonded magnet. The method comprises the steps of: (a) forming a melt comprising, by weight, about 15% to 25% of RE; about 0.8% to 2.0% of B; about 1% to 10% of T; and balanced with Fe, Co, or mixtures thereof, wherein RE is one or more rare earth elements selected from the group consisting of Y, La, Ce, Pr, Nd, Sm, Er, Gd, Tb, Dy, Ho, Tm, Yb and Lu, and T is one or more elements selected from the group consisting of Ti, Zr, Hf, V, Nb, Ta, Cr, Mo, and W; (b) atomizing the melt to obtain magnetic powders; (c) heat treating the thus obtained powders; (d) mixing or coating the powders with a binder; (e) pressing and/or molding the powders and binder; and (f) curing the binder, if necessary.

In a preferred embodiment of the present invention, the magnetic powders formed by atomization comprise a metallurgically complex structure substantially having the formula of $Nd_2Fe_{14}B$. The alloy melt in step (a) of the present invention may further comprise additional elements such as Cu, Si, Al, Sn, and Ga present in quantities up to 1%, and may also further comprise other elements such as C, N, O, P, and S, present as impurities.

The atomizing step of the present invention may be performed according to one or more of the following processes: gas atomization, centrifugal atomization, water atomization, vacuum atomization, plasma spraying, and sputtering. Preferably, the atomizing step comprises centrifugal atomization by spinning the wheel or cup at a rate of greater than about 20,000 rpm and the powders obtained are cooled under helium. More preferably, the centrifugal atomization comprises spinning the wheel or cup at a rate of between about 20,000 rpm and about 35,000 rpm and, most preferably, between about 24,000 rpm and about 33,000 rpm.

In a preferred embodiment of the present invention, the atomized magnetic powders are substantially spherical and have diameters ranging from about 1 $\mu$m to about 200 $\mu$m. In another preferred embodiment, the magnetic powders comprise a mixture of particles that are substantially spherical and have diameters ranging from about 1 $\mu$m to about 200 $\mu$m with flake particles that are between about 50 $\mu$m and about 500 $\mu$m in length and between about 20 $\mu$m and about 100 $\mu$m in thickness.

According to the present invention, the heat treating step preferably comprises annealing the powders at a temperature between 600° C. and 800° C. Also, the binder used in the present invention is preferably one or more of thermosetting resins, thermoplastic resins, and metals. More preferably, the binder is polyamide, PPS, natural or synthetic rubber, epoxy, or zinc. Molding processes that can be used in the present method include compression molding, extrusion, injection molding, calendering, screen printing, spin casting, and slurry coating.

In another preferred embodiment of the present invention, the powder and binder are injection-molded to make the bonded magnet. More preferably, the loss of intrinsic coercivity of the bonded magnet is less than about 5% after four injection molding cycles.

In another preferred embodiment of the present invention, the volumetric loading of the magnetic powder in the powder-binder mixture is from about 40% to about 99% and the internal shearing loss of the magnet is less than about 4%. In another aspect, the volumetric loading of the magnetic powder in the powder-binder mixture is about 69% or greater and wherein the magnet has no cracking and/or physical distortion and can be manufactured using conventional equipment.

The present invention further provides atomized magnetic powders that have good flowability. For example, the magnetic powders are capable of flowing through a standard Hall flowmeter orifice (2.54 mm in diameter) at a rate of more than about 2 grams per second, and preferably more than about 3.5 grams per second. The atomized powders of the present invention, when mixed with a binder, also have low viscosities as compared to conventional magnetic powders. For example, the magnetic powders when mixed with a polyamide resin have an apparent viscosity of less than about 500 poise at a shear rate of more than about 20 $\text{second}^{-1}$ and a temperature of about 240° C.

In another preferred embodiment, the bonded magnets produced in accordance with the present invention have lower loss of magnetic energy when exposed to elevated temperatures for a substantial period of time. For example, the bonded magnets of the present invention have a loss of remanence of less than about 30% when exposed to a temperature of about 260° C. for about 200 hours and/or a flux loss of less than about 3% when aged at a temperature of about 100° C. for about 2000 hours.

DETAILED DESCRIPTION OF THE PREFERRED EMBODIMENTS

According to the present invention, magnets, particularly bonded magnets, are made from magnetic powders produced by atomization and composition control. The magnets thus produced exhibit one or more of the following properties as compared to conventional magnets: (1) less loss of intrinsic coercivity under repeated injection molding cycles; (2) less internal magnetic shearing loss; (3) improved Br due to higher volumetric loading capacity of the magnetic powders; (4) higher part integrity due to the good flowability of the magnetic powders; (5) less environmental degradation after exposure to high temperature; (6) less flux loss; (7) complex shapes and high part integrity due to smaller powder particle size; (8) lower viscosity of the magnetic powder-binder mixtures; and (9) high magnetic strength even for small-dimension magnets.

In one aspect, the present invention provides a magnet, particularly a bonded magnet made from magnetic powders that are obtained by an atomization process and comprise, by weight, about 15% to 25% of RE; about 0.8% to 2.0% of B; about 1% to 10% of T; and balanced with Fe, Co, or mixtures thereof, wherein RE is one or more rare earth elements selected from the group consisting of Y, La, Ce, Pr, Nd, Sm, Er, Gd, Th, Dy, Ho, Tm, Yb and Lu, and T is one or more elements selected from the group consisting of Ti, Zr, Hf, V, Nb, Ta, Cr, Mo, and W.

In a preferred embodiment, the bonded magnet of the present invention is made of atomized magnetic powders comprising a metallurgically complex structure substantially having the formula $Nd_2Fe_{14}B$ as the primary magnetic phase. The magnetic powders of the present invention may further comprise one or more of additional elements such as Cu, Si, Al, Sn, and Ga present in quantities up to 1%, and may also further comprise other elements such as C, N, O, P, and S, present as impurities.

In a more preferred embodiment, the present invention provides magnets made from magnetic powders that comprise, by weight, about 18% to 20% of Nd, about 1.8% to 2.2% of Ti, about 3.8% to 4.2% of Zr, about 1.4% to 1.8% of B, and balanced with Fe. In another more preferred embodiment, the magnetic powders comprise, by weight, about 23% to 24% of Nd, about 3.8% to 4.2% of Co, about 1.1% to 1.3% of B, about 1.4% to 1.6% of Ti, about 2.2% to 2.4% of Zr, about 0.1% to 0.3% of Cu, and balanced with Fe. In yet another more preferred embodiment of the present invention, the magnetic powders comprise, by weight, about 22% to 23% of Nd, about 8% to 10% of Co, about 1.1% to 1.3% of B, about 1.7% to 1.8% of Nb, about 3.1% to 3.3% of Zr, about 0.1% to 0.3% of Cu, about 0.1% to 0.3% of C, and balanced with Fe.

In another preferred embodiment of the present invention, the bonded magnets are made from magnetic particles that are substantially spherical or globular and have diameters ranging from about 1 $\mu$m to about 200 $\mu$m; more preferably from about 1 $\mu$m to about 150 $\mu$m; and most preferably from about 1 $\mu$m to about 100 $\mu$m. The substantially spherical shape enables the magnetic powders to have better flowability than flake or plate powders produced from melt spun ribbons. As is understood by those of ordinary skill in the art, a better flowability and packing of the powder results in a higher volumetric fraction of the magnetic powder in the powder-binder mixture. The higher volumetric fraction in turn results in a stronger magnet with more complex shapes and higher part integrity. Higher flowability is especially good for injection molding when making a bonded magnet. For example, the magnetic powders of the present invention are capable of flowing through a standard Hall flowmeter orifice (2.54 mm in diameter) at a rate of more than about 2 grams per second, and preferably more than about 3.5 grams per second. The atomized powder-binder mixtures of the present invention also have low viscosities as compared to conventional magnetic powder-binder mixtures. For example, the magnetic powder-polyamide binder mixtures has an apparent viscosity of less than about 500 poise at a shear rate of more than about 20 second$^{-1}$ and a temperature of about 240° C.

In another preferred embodiment of the present invention, the magnets are made from magnetic powders that comprise a mixture of particles that are substantially spherical and have diameters ranging from about 1 $\mu$m to about 200 $\mu$m with flake particles that are from about 50 $\mu$m to about 500 $\mu$m in length and from about 20 $\mu$m to about 100 $\mu$m in thickness.

As one of ordinary skill in the art would be aware, the maximum volumetric fraction of magnetic powders for injection molding is usually around 63% for conventional flake magnetic powders. Higher volumetric fraction results in cracking and/or distortion of the magnet, or becomes impossible to manufacture using conventional injection molding equipment. The present invention, on the other hand, enables a volumetric fraction of at least as high as 69% for injection molding without resulting in cracking or distortion of the final magnet, and while still being possible to manufacture using conventional injection molding equipment. This enables the production of magnets with complex shapes possessing higher mechanical strength and improved magnetic properties, as compared to conventional magnets.

The substantially spherical particle shape, together with a narrower particle size distribution, also enables the magnetic powders of the present invention to achieve higher packing density. This also contributes to the ability to produce bonded magnets that are both mechanically strong and suitable for more applications. Furthermore, the bonded magnets of the present invention can be either isotropic or anisotropic. The magnets may also be either rigid or flexible.

The bonded magnet of the present invention may be produced from magnetic powders obtained through any atomization process. As understood by one of ordinary skill in the art, atomization is the breakup of a liquid into small droplets. Different types of atomization processes, such as gas atomization, water atomization, vacuum atomization, centrifugal atomization, and ultrasonic atomization, have been used for years to produce certain alloy powders. As used herein, water or gas atomization refers to the breakup of a liquid stream brought about by high pressure jets of water or gas. The use of centrifugal effects, achieved by introducing a liquid stream of molten alloy onto a rotating cup or wheel, so as to break up the liquid stream as it is thrown off the cup in a radial direction, is referred herein as centrifugal atomization. The use of vacuum or ultrasonic force to break up a liquid stream is referred as vacuum or ultrasonic atomization, respectively. Furthermore, for the purpose of the present invention, processes such as plasma spraying and sputtering are also considered as atomization processes. The magnets of the present invention are preferably made from magnetic powders produced by a centrifugal, gas, or water atomization process.

The bonded magnet of the present invention can be produced through a variety of pressing/molding processes, including, but not limited to, compression molding, extrusion, injection molding, calendering, screen printing, spin casting, and slurry coating. As discussed, because of the high flowability and loading capacity of the present invention's magnetic powders, injection molding can be used to produce bonded magnets that could previously only be made using extrusion or compression molding of conventional powders. This results in magnets with complex shapes and high part integrity.

In another preferred embodiment of the present invention, bonded magnets are produced through injection-molding such that the loss of intrinsic coercivity of the bonded magnet is lower than that of conventional injection-molded bonded magnets. For example, the loss of intrinsic coercivity of the present bonded magnet can be less than about 5% after four injection molding cycles. Furthermore, the internal magnetic shearing loss, or internal loss of the present invention's magnetic powders is lower than that of conventional magnetic powders.

In another preferred embodiment of the present invention, bonded magnets with very small dimensions yet high magnetic strength are provided. In this embodiment, the total volume of the bonded magnet is less than about 50 mm$^3$ and the greatest dimension of the magnet is less than about 5 mm. At the same time, the magnetic flux density of the magnet is greater than that which can be achieved using conventional flake powders. In a preferred embodiment, the Br value for such magnets is greater than about 4.0 kGauss and, more preferably, greater than about 4.8 kGauss.

In another aspect, the present invention provides a method of making a bonded magnet. The method comprises the steps of: (a) forming a melt comprising, by weight, about 15% to 25% of RE; about 0.8% to 2.0% of B; about 1% to 10% of T; and balanced with Fe, Co, or mixtures thereof, wherein RE is one or more rare earth elements selected from the group consisting of Y, La, Ce, Pr, Nd, Sm, Er, Gd, Tb, Dy, Ho, Tm, Yb and Lu, and T is one or more elements selected from the group consisting of Ti, Zr, Hf, V, Nb, Ta, Cr, Mo, and W; (b) atomizing the melt to obtain magnetic powders; (c) heat treating the thus obtained powders; (d) mixing or coating the powders with a binder; (e) pressing and/or molding the powders and binder; and (f) curing the resultant magnet body, if necessary. The various embodiments discussed earlier are also suitable for use as the composition for the melt and the magnetic powder produced thereof in the method of the present invention.

The atomizing step of the present invention includes one or more of the following processes: gas atomization, centrifugal atomization, water atomization, vacuum atomization, ultrasonic atomization, plasma spraying, and sputtering. Preferably, the centrifugal, gas, or water atomization is used. More preferably, the atomizing step of the present invention comprises centrifugal atomization. Centrifugal atomization is general referred to as the breakup of a liquid stream into droplets by centrifugal force. In the present invention, centrifugal atomization is referred as the use of centrifugal effects, achieved by introducing a liquid stream of molten alloy onto a rotating cup or wheel, so as to break up the liquid stream as it is thrown off the cup in a radial direction.

A specific centrifugal process which may be used in the present invention is as follows: A molten alloy is poured through a nozzle onto a rotating water-cooled cup or wheel located near the top of an atomization vessel. The melt is thrown off of the cup in a radial direction due to centrifugal effects. As the melt leaves the cup, it forms a thin liquid sheet, which then forms elongated ligaments, which in turn break up into individual liquid metal droplets. These droplets spherodize and solidify as they fall towards the bottom of the atomization vessel. The natural convective cooling resulting from the droplets' passage through the atmosphere in the chamber may optionally be enhanced by the use of high-velocity jets of inert gas (specifically helium) directed downwards towards the droplets after they leave the cup. The powder is collected from the bottom of the atomization vessel. Preferably in centrifugal atomization process of the present invention, the rotating cup or wheel spins at a speed of greater than about 20,000 rpm. More preferably, the centrifugal atomization comprises spinning the cup or wheel at a rate of between about 20,000 rpm and about 35,000 rpm and, most preferably, between about 24,000 rpm and about 33,000 rpm. Any liquid or gas medium commonly used for cooling the powders obtained through the atomization process can be used in the present invention. Preferably, the powders obtained are cooled under helium.

In a preferred embodiment of the present invention's method, the atomized magnetic powders are substantially spherical and have diameters ranging from about 1 $\mu$m to about 200 $\mu$m. In another preferred embodiment, the magnetic powders comprise a mixture of particles that are substantially spherical and have diameters ranging from about 1 $\mu$m to about 200 $\mu$m with flake particles that are between about 50 $\mu$m and about 500 $\mu$m in length and between about 20 $\mu$m and about 100 $\mu$m in thickness.

According to the method of the present invention, magnetic powders obtained by the atomization process are heat treated to improve their magnetic properties. Any commonly employed heat treatment method can be used, although the heat treating step preferably comprises annealing the powders at a temperature between 600 and 800° C. to obtain the desired magnetic properties.

After heat treating the atomized powders of the present invention, the powders are mixed with a suitable binder to prepare the formation of the bonded magnet. Any binder commonly used is suitable for this purpose. Preferably, the binder used in the present invention is a thermosetting resin, a thermoplastic resin, a metal, or a mixture thereof. More preferably, the binder is polyamide, PPS, natural or synthetic rubber, or epoxy, or zinc.

The pressing and/or molding step in the present invention includes compression molding, extrusion, injection molding, calendering, screen printing, spin casting, and slurry coating. As discussed, due to the high flowability and loading capacity of the present invention's magnetic powders, injection molding can be used to produce bonded magnets that could previously only be made using extrusion or compression molding of conventional powders. This results in magnets with complex shapes and high part integrity.

In another preferred embodiment of the present invention's method, the powder and binder are injection-molded to make the bonded magnet. Partly due to the substantially spherical nature of the present invention's magnetic powders, the loss of intrinsic coercivity of the bonded magnet is low, e.g., less than about 5% after four injection molding cycles, as compared to conventional bonded magnets. Furthermore, the internal magnetic shearing loss, or internal loss of the present invention's magnetic powders is lower than that of conventional magnetic powders. For example, when the volumetric loading of the magnetic powder in the powder-binder mixture is from about 40% to about 99%, the internal loss of the present invention's magnet is less than about 4%. In another aspect, the volumetric loading of the magnetic powder of the present invention in the powder-binder mixture is about at least as high as 69% and wherein the magnet has no cracking and/or physical distortion, and can be manufactured using conventional equipment.

In another preferred embodiment, the bonded magnets produced in accordance with the present invention have lower loss of magnetic energy when exposed to elevated temperatures for a substantial period of time. For example, the bonded magnets of the present invention have a loss of remanence of less than about 30% when exposed to a temperature of about 260° C. for about 200 hours and/or a flux loss of less than about 3% when aged at a temperature of about 100° C. for about 2000 hours.

In the case where the binder used is a thermosetting resin, the curing step of the present invention is performed at an elevated temperature and for a time period sufficient to cure the particular binder used. A person of ordinary skill in the art would know conditions under which a specific binder with the specific magnetic powders involved can be cured.

EXAMPLES

In the following examples, unless otherwise stated, all compositions are given in weight %.

Comparative Product 1

An alloy of nominal composition of 27.5% Nd, 5% Co, 0.9% B, balance Fe as melt-spun and subsequently annealed. The isotropic powders thus obtained were comminuted to a particle size of about 150 $\mu$m. It was compounded with polyamide binder. The compound was injection molded to make a cylinder of 10 mm diameter and 6 mm height with a yield of about 30% due to runners and sprues. The intrinsic coercivity of the sample was measured using a hysteresis graph. The runners and the sprues were recycled by attrition and then injection molded again, and the intrinsic coercivity of the sample was determined. The percent loss of intrinsic coercivity was determined. The injection molding/recycling cycle was repeated a total of 4 times and the loss in intrinsic coercivity was determined after each cycle. The loss values are given in Table 1.

TABLE 1

| Injection Molding Cycle | Comparative Product 1 Intrinsic Coercivity Loss (%) | Example 1 Intrinsic Coercivity Loss (%) |
|---|---|---|
| Initial | 0 | 0 |
| First | 9.0 | 0.5 |
| Second | 15.5 | 2.0 |
| Third | 19.5 | 3.4 |
| Fourth | 22.0 | 4.2 |

Example 1

An alloy of nominal composition of 19% Nd, 2% Ti, 4% Zr, 1.6% B, and balance Fe was made into powder by centrifugal atomization by spinning wheel at about 30,000 rpm and the isotropic powders thus obtained were cooled under Helium. The powders thus obtained were substantially spherical in shape. The average particle size of the powder was about 55 μm. After suitable heat treatment the powder was compounded with polyamide, similar to Comparative Product 1. Bonded magnets were made as given in Comparative Product 1 and tests were carried out similar to Comparative Product 1 to determine the intrinsic coercivity losses. The values are also given in Table 1.

As shown in Table 1, the intrinsic coercivity losses are less than 5% for the bonded magnet of the present invention, as given in Example 1, compared to 22% for that of a conventional magnet, as represented by Comparative Product 1. This demonstrates that the present invention can be used to make bonded magnets in which, among other things, the runner and sprues can be reused without appreciable loss of magnetic properties for the magnet. This makes it possible to make magnets with lower cost and improved performance.

Comparative Product 2

Bonded Nd—Fe—B type magnets were made using melt-spun powder of similar composition as Comparative Product 1. Herein the amount of magnet powder varied from 40% up to 80% by volume. The magnetic remanences of the samples were measured and correlated to the volume content of magnetic powder in the samples. The magnetic particles in the bonded magnet were diluted with binder and were insulated from each other. Due to this process the powder operated in a magnetically sheared state, leading to internal magnetic shearing loss (referred to herein as internal loss). This causes a reduction in magnetic properties of the bonded magnet. Table 2, Comparative Product 2, gives the internal loss.

TABLE 2

| Magnetic Material Loading, Vol. (%) | Comparative Product 2 Internal Loss (%) | Example 2 Internal Loss (%) |
|---|---|---|
| 80 | 3.9 | 2.0 |
| 70 | 4.9 | 2.7 |
| 60 | 5.1 | 3.0 |
| 50 | 5.7 | 3.1 |
| 40 | 5.1 | 2.4 |

Example 2

In this example, the atomized powder of the composition as given in Example 1 was used to make bonded magnets. As for Comparative Product 2, the magnet powder content was varied from 40% up to 80% by volume. The internal losses were determined for various volume loading levels, and are given in Table 2, Example 2.

Table 2 shows the internal losses of bonded magnets made by using melt spun and atomized magnetic powders. By using atomized powders of the present invention (Table 2, Example 2), bonded magnets have lower internal losses at various levels of magnetic powder loading and hence improved magnetic properties.

Comparative Product 3

An alloy of nominal composition of 20% Nd, 6.5% Pr, 1.3% B, 0.08% Cu, and balance Fe was melt-spun and subsequently annealed. The isotropic powders thus obtained were comminuted to a particle size of about 150 μm. The powders were used to make bonded magnets by injection molding. Various amounts of magnet powders were used with polyamide binder giving volumetric loading of magnetic material of, by volume, 63%, 67% and 69% (volumetric fractions). The maximum loading which could be used in injection molding for conventional magnetic powders was 63 vol. %. Higher volumetric loading showed cracking and/or distortion, or exceeded the capability of the injection molding equipment, and no good injection molded magnets could be realized.

Example 3

An alloy of the composition as given in Example 1 was atomized by centrifugal atomization as described in Example 1. The mean particle size of the powders was about 55 μm. After heat treatment, the powders were mixed with polyamide binder as given in Comparative Product 3 to give volumetric loading of magnetic material of, by volume, 63%, 67% and 69%. Compounded compositions with up to 72 vol. % of atomized powders could be processed in producing injection molded magnets. There was no cracking or distortion of the magnets. The improvement of magnetic properties, Br in this case, due to increased volumetric loading of the magnetic material is given in Table 3.

TABLE 3

| Magnetic Material Loading (vol. %) | Comparative Product 3 Magnet Br (kGauss) | Example 3 Magnet Br (kGauss) |
|---|---|---|
| 63 | 5.05 | 4.68 |
| 67 | could not be produced | 5.00 |
| 69 | could not be produced | 5.15 |
| 72 | could not be produced | 5.35 |

As can be seen from Table 3, according to the present invention, as given in Example 3, bonded magnets of high magnetic loading can be made with improved magnetic properties without distortion and/or cracking.

Comparative Product 4

An alloy of composition as given in Comparative Product 1 was melt spun and comminuted to particle size of about 150 μm. The powders were tested for flow behavior by using Standard Hall Flow Test equipment. The time taken for 50 grams of the powders to flow through a standard Hall flowmeter orifice (2.54 mm) was measured. The comminuted melt spun powders would not flow through the orifice, indicating poor flowability. To improve the flow behavior it was coated with binder of epoxy (2% by weight) and tested. The flow time was 34 seconds.

Example 4

An alloy of nominal composition of 23.3% Nd, 4% Co, 1.22% B, 1.55% Ti, 2.36% Zr, 0.2% Cu, and balance Fe was atomized. The average particle size as atomized was 55 μm. The powders were tested for flow behavior as given in Comparative Product 4. The flow time was 17 seconds.

It can be seen that magnetic powders of the present invention, as represented by Example 4, flow very easily, whereas conventional powders, as represented by Comparative Product 4, could not flow through the orifice and took much longer time to flow through even after coating with epoxy. The excellent flowability of the present invention leads to easy consistent flow into the dies while making magnets, leading to the ability to form tall parts, parts with good surface finish, thin parts, etc. In general the bonded magnet of the present invention will have high part integrity.

Comparative Product 5

An alloy of the composition as given in Comparative Product 1 was melt-spun and comminuted to less than about 100 μm in particle size. The powders were annealed to optimize the magnetic properties. The powders were then exposed to a temperature of about 260° C. for up to 200 hours and the percent loss in remanence was determined. The result is given in Table 4, Comparative Product 5.

TABLE 4

| Time of Exposure (hours) | Loss in Remanence (%) Comparative Product 5 | Loss in Remanence (%) Example 5 |
|---|---|---|
| 0 | 0 | 0 |
| 24 | 56 | 8 |
| 48 | 68 | 10 |
| 200 | 80 | 24 |

Example 5

An alloy of the nominal composition of 22.6% Nd, 9% Co, 1.2% B, 1.8% Nb, 3.2% Zr, 0.2% Cu, 0.2% C, and balance Fe was atomized to an average particle size of about 55 μm. The powders were annealed to optimize the magnetic properties. Tests were carried out, as given in Comparative Product 5, by exposing the powders to 260° C. for various time intervals. The percent loss in remanence is given in Table 4, Example 5.

As can be seen from Table 4, the atomized powders of the present invention, Example 5, show less environmental degradation after exposure to high temperature, as compared to the conventional melt spun magnetic powders, as represented by Comparative Product 5. In fact, after 24 hours of exposure, the present invention's magnetic powders lost only 8% of the remanence, as compared to the 56% loss of conventional magnetic powders, as represented by Comparative Product 5. The results demonstrate that the material of the present invention can be used directly for bonded magnets, since the particle sizes are already at about 55 μm or less after atomization, without a comminution process (breaking into finer sizes, attrition etc). Further there is less degradation of magnetic properties as compared to conventional materials, indicating ease of operation during processing to make bonded magnets.

Comparative Product 6

An alloy of the nominal composition as given in Comparative Product 1 was melt spun and comminuted to powders of about 150 μm in size and annealed to optimize magnetic properties. Compression-molded magnets with diameters of about 10 mm and lengths of about 8 mm were made with epoxy as the binder. The magnetic material loading was 80% by volume. The magnets were aged at 100° C. for 2000 hours and the flux loss was determined to be 5.2%.

Example 6

An alloy of the nominal composition as given in Example 1 was made into powders by centrifugal atomization as given in Example 1. The spherical powders of particle size of about 55 μm were annealed to optimize magnetic properties. Compression-molded magnets were made as given in Comparative Product 6, with magnetic material loading of 80% volume. The magnets were then aged at 100° C. for 2000 hours and flux loss was determined as given in Comparative Product 6. The flux loss was 2.8%.

As can be seen from Comparative Product 6 and Example 6, the bonded magnets of the present invention, as represented by Example 6, have lower flux losses compared to that of conventional bonded magnets, as represented by Comparative Product 6.

Comparative Product 7

The annealed powders of Comparative Product 1 were compounded with polyamide binder to achieve a magnetic material loading of 60% by volume. The apparent viscosity of the compound was determined as a function of shear rate at 240° C. using a capillary rheometer. The values are given in Table 5, Comparative Product 7.

TABLE 5

| Shear Rate (l/s) | Apparent Viscosity (poise) Comparative Product 7 | Apparent Viscosity (poise) Example 7 |
|---|---|---|
| 23.2 | 4864 | 492 |
| 92.8 | 3020 | 356 |
| 521.8 | 1531 | 259 |
| 927.7 | 1176 | 219 |

Example 7

The magnetic powders as given in Example 1 were used in annealed condition in this Example. The powders were then compounded with a binder as given in Comparative Product 7 to 62% volume loading of magnetic material. The viscosity of the compound was determined as a fiction of shear rate as given in Comparative Product 7 and is given in Table 5, Example 7.

It can be seen that the magnetic powder-binder mixtures of the present invention, as represented by Example 7, have lower viscosity as compared to that of conventional powders, as represented by Comparative Product 7. In fact, the viscosity of the present invention magnetic powder-binder mixtures was about 5 to 10 times lower, depending on the shear rate, than that of the conventional magnetic powders, even though the present invention's powders were loaded slightly more than the conventional powders. The low viscosity helps in making bonded magnets with good forming capabilities, resulting in intricate and complex shapes with high dimensional tolerance exhibiting fine features. In general, high part integrity is obtained. This also helps in easy processing for high-volume production with lower cost.

Comparative Product 8

The magnetic powders as given in Comparative Product 1 were used in annealed condition. The powders were compounded with a polyamide binder using a volumetric loading factor of 55.4% which is known to result in bonded magnets typically having a magnet Br of about 4.9 kGauss. Bonded magnets with very small dimensions (2.5 mm OD×1.0 mm ID×2.0 mm long) were injection-molded using this compounded material. After magnetizing the part, the magnetic properties were measured in a special fixture equipped with a fluxmeter probe. The magnetic field strength at a fixed distance from the surface of the small magnet was 580±50 Gauss, corresponding to an actual magnet $B_r$ of about 3.9 kGauss.

Example 8

The atomized powders of Example 1 were used in this case. The powders were annealed to optimize magnetic properties, as given in Comparative Product 8. The powders were then compounded with polyamide binder as described in Comparative Product 8, using a volumetric loading factor of 64.7%, which is known to result in bonded magnets typically having a magnet Br of about 4.9 kGauss. The powders were injection-molded to obtain bonded magnets with very small dimensions, also as given in Comparative Product 8. After magnetizing the part, the magnetic properties were measured in a special fixture equipped with a fluxmeter probe, also as given in Comparative Product 8. The magnetic field strength at a fixed distance from the surface of the small magnet was 720±20 Gauss, corresponding to an actual magnet $B_r$ of about 4.8 kGauss.

These results demonstrate that bonded magnets made from atomized powders according to the present invention possess high magnetic strength even if made into magnets of very small dimensions. In contrast, the bonded magnets having very small dimensions that were produced from Comparative Product 8 exhibit poor filling and high porosity, resulting in magnetic properties significantly reduced from the expected value based on the compounded magnetic powder-binder mixture. This quality of the present invention's magnets is attributable to the easy flowability of the spherical atomized powders that help in better loading, filling and less porosity in the magnets.

The present invention has been explained generally and by reference to the preceding examples that describe in detail the preparation of the magnetic powders and the bonded magnets of the present invention. The examples also demonstrate the superior and unexpected properties of the magnets and magnetic powders of the present invention. The preceding examples are illustrative only and in no way limit the scope of the present invention. It will be apparent to those skilled in the art that many modifications, both to products and methods, may be practiced without departing from the purpose and scope of this invention.

What is claimed is:

1. A bonded magnet made from magnetic powders obtained by an atomization process, said powders comprising, by weight, above 15% to about 25% of RE; about 0.8% to about 2.0% of B; about 1% to about 10% of T; and balanced with Fe, Co, or mixtures thereof, wherein RE is one or more rare earth elements selected from the group consisting of Y, La, Ce, Pr, Nd, Sm, Er, Gd, Tb, Dy, Ho, Tm, Yb and Lu; and T is one or more elements selected from the group consisting of Ti, Zr, Hf, V, Nb, Ta, Cr, Mo, and W; and wherein the magnetic powders comprise a metallurgically complex structure substantially having the formula of $Nd_2Fe_{14}B$ as the primary magnetic phase.

2. The bonded magnet of claim 1, wherein the magnetic powders comprise, by weight, about 18% to about 20% of Nd, about 1.8% to about 2.2% of Ti, about 3.8% to about 4.2% of Zr, about 1.4% to about 1.8% of B, and balanced with Fe.

3. The bonded magnet of claim 1, wherein the magnetic powders further comprise one or more of Cu, Si, Al, Sn, and Ga, in an amount of 1%, by weight, or less.

4. The bonded magnet of claim 3, wherein the magnetic powders comprise, by weight, about 23% to about 24% of Nd, about 3.8% to about 4.2% of Co, about 1.1% to about 1.3% of B, about 1.4% to about 1.6% of Ti, about 2.2% to 2.4% of Zr, about 0.1% to 0.3% of Cu, and balanced with Fe.

5. The bonded magnet of claim 3, wherein the magnetic powders further comprise one or more of N, O and P as impurities and comprise, by weight, about 22% to about 23% of Nd, about 8% to about 10% of Co, about 1.1% to about 1.3% of B, about 1.7% to about 1.8% of Nb, about 3.1% to about 3.3% of Zr, about 0.1% to about 0.3% of Cu, about 0.1% to about 0.3% of C, and balanced with Fe.

6. The bonded magnet of claim 1, wherein the magnetic powders are substantially spherical and have diameters ranging from about 1 $\mu$m to about 200 $\mu$m.

7. The bonded magnet of claim 1, wherein the magnetic powders comprise a mixture of particles that are substantially spherical and have diameters ranging from about 1 $\mu$m to about 100 $\mu$m.

8. The bonded magnet of claim 1, said magnet being isotropic.

9. The bonded magnet of claim 1, wherein the atomization process is selected from one or more of gas atomization, centrifugal atomization, water atomization, vacuum atomization, plasma spraying, and sputtering.

10. The bonded magnet of claim 1, wherein the magnet further comprises a binder selected from the group consisting of thermosetting resins, thermoplastic resins, metals, and mixtures thereof.

11. The bonded magnet of claim 10, wherein the binder is polyamide, poly(phenylene sulfide), natural or synthetic rubber, or epoxy.

12. The bonded magnet of claim 10, wherein the magnet is obtained through compression molding, extrusion molding, injection molding, calendering, screen printing, spin casting, slurry coating, or combinations thereof.

13. The bonded magnet of claim 12, wherein the magnet is obtained through injection molding.

14. The bonded magnet of claim 13, wherein the loss of intrinsic coercivity of the magnet after four injection molding cycles is less than about 5%.

15. The bonded magnet of claim 10, said magnet having been made from a mixture of the magnetic powders and the binder.

16. The bonded magnet of claim 15, wherein the magnetic powders comprise from about 40% to about 99%, by volume, of the magnetic powder-binder mixture and the internal loss of the bonded magnet is less than about 4%.

17. The bonded of claim 15, wherein the magnetic powders comprise greater than about 63%, by volume, of the magnetic powder-binder mixture and wherein the magnet has no cracking and/or physical distortion.

18. The bonded magnet of claim 15, wherein the magnetic powder-binder mixture has an apparent viscosity of less than about 500 poise at a shear rate of more than about 20 $\text{second}^{-1}$ and a temperature of about 240° C.

19. The bonded magnet of claim 1, wherein the magnetic powders flow through a standard orifice at a rate of more than about 2 grams per second.

20. The bonded magnet of claim 19, wherein the magnetic powders flow through a standard orifice at a rate of more than about 3.5 grams per second.

21. The bonded magnet of claim 1, wherein the bonded magnet has a loss of remanence of less than about 30% when exposed to a temperature of about 260° C. for about 200 hours.

22. The bonded magnet of claim 1, wherein the bonded magnet has a flux loss of less than about 3% when aged at a temperature of about 100° C. for about 2000 hours.

23. The bonded magnet of claim 1, wherein the total volume of the magnet is less than about 50 $mm^3$ and the greatest dimension of the magnet is less than about 5 mm.

24. The bonded magnet of claim 23, wherein the magnet has a $B_r$ value of greater than about 4.0 kGauss.

25. A bonded magnet made from magnetic powders obtained by an atomization process, said powders comprising, by weight, about 18% to about 25% of RE; about 0.8% to about 2.0% of B; about 1% to about 10% of T; and balanced with Fe, Co, or mixtures thereof, wherein RE is one or more rare earth elements selected from the group consisting of Y, La, Ce, Pr, Nd, Sm, Er, Gd, Tb, Dy, Ho, Tm, Yb and Lu; and T is one or more elements selected from the group consisting of Ti, Zr, Hf, V, Nb, Ta, Cr, Mo, and W; and wherein the magnetic powders comprise a metallurgically complex structure substantially having the formula of Nd2Fe14B as the primary magnetic phase.

26. A bonded magnet made from magnetic powders obtained by an atomization process, said powders comprising, by weight, about 18% of RE; about 0.8% to about 2.0% of B; about 1% to about 10% of T; and balanced with Fe, Co, or mixtures thereof, wherein RE is one or more rare earth elements selected from the group consisting of Y, La, Ce, Pr, Nd, Sm, Er, Gd, Tb, Dy, Ho, Tm, Yb and Lu; and T is one or more elements selected from the group consisting of Ti, Zr, Hf, V, Nb, Ta, Cr, Mo, and W; and wherein the magnetic powders comprise a metallurgically complex structure substantially having the formula of Nd2Fe14B as the primary magnetic phase.

* * * * *